US012188383B2

(12) United States Patent
Raimondi et al.

(10) Patent No.: US 12,188,383 B2
(45) Date of Patent: Jan. 7, 2025

(54) METAL SHEET STAMPED ROCKER ARM ASSEMBLY WITH LATCHING PIN ASSEMBLY

(71) Applicant: Eaton Intelligent Power Limited, Dublin (IE)

(72) Inventors: Emanuele Raimondi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/253,974

(22) PCT Filed: Nov. 30, 2021

(86) PCT No.: PCT/EP2021/025476

§ 371 (c)(1),
(2) Date: May 23, 2023

(87) PCT Pub. No.: WO2022/111856

PCT Pub. Date: Jun. 2, 2022

(65) Prior Publication Data

US 2024/0093621 A1 Mar. 21, 2024

Related U.S. Application Data

(60) Provisional application No. 63/119,178, filed on Nov. 30, 2020.

(51) Int. Cl.
*F01L 1/18* (2006.01)
*F01L 1/46* (2006.01)

(52) U.S. Cl.
CPC ..... *F01L 1/181* (2013.01); *F01L 1/46* (2013.01); *F01L 2001/186* (2013.01); *F01L 2001/467* (2013.01); *F01L 2303/00* (2020.05)

(58) Field of Classification Search
CPC ..... F01L 1/181; F01L 2303/00; F01L 1/46; F01L 2001/467; F01L 2001/186
See application file for complete search history.

(56) References Cited

U.S. PATENT DOCUMENTS

| | | | |
|---|---|---|---|
| 10,533,463 | B1 | 1/2020 | Mariuz et al. |
| 2014/0182528 | A1 | 7/2014 | Jeon et al. |
| 2017/0009610 | A1 | 1/2017 | Ahmed et al. |

FOREIGN PATENT DOCUMENTS

| | | | |
|---|---|---|---|
| WO | 2020/030298 | A1 | 2/2020 |
| WO | 2021/239273 | A1 | 12/2021 |
| WO | 2022/100886 | A1 | 5/2022 |

OTHER PUBLICATIONS

International Search Report issued in corresponding application No. PCT/EP2021/025476 dated Apr. 7, 2022, 4 pages.
Written Opinion issued in corresponding application No. PCT/EP2021/025476 dated Apr. 7, 2022, 8 pages.

*Primary Examiner* — Ngoc T Nguyen
(74) *Attorney, Agent, or Firm* — Meunier Carlin & Curfman LLC

(57) ABSTRACT

A rocker arm assembly can include a latch assembly, a primary arm configured to receive the latch assembly, and a secondary arm configured to receive the latch assembly. The secondary arm includes a secondary arm body and a piston support ring. A pivot slot passes through the primary arm, the secondary arm body, and the piston support ring.

19 Claims, 8 Drawing Sheets

METAL SHEET STAMPED ROCKER ARM ASSEMBLY WITH LATCHING PIN ASSEMBLY

CROSS-REFERENCE TO RELATED APPLICATIONS

This is a National Stage application of PCT international application PCT/EP2021/025476, filed on Nov. 30, 2021, which claims priority to U.S. Provisional Patent Application No. 63/119,178, filed Nov. 30, 2020, both which are incorporated herein by reference in their entireties.

FIELD

This application provides a latching pin assembly usable in a deactivating rocker arm assembly.

BACKGROUND

An internal combustion engine includes a valve train assembly. A valve train assembly includes rocker arms for controlling opening and closing of intake and exhaust valves. A rocker arm is a reciprocating lever that translates radial motion of a rotating camshaft lobe into linear motion that controls the opening and closing of a valve. A rocker arm is mounted on a rocker shaft with one end in direct or indirect contact with the rotating camshaft lobe and the other end being structurally interfaced with a valve.

Variable valve actuation mechanisms, such as cylinder deactivation and variable valve lift, have been introduced to improve engine performance, fuel economy and/or emissions of an internal combustion engine during periods of light engine load. To support a variable valve actuation mechanism, a switchable rocker arm can be used. A switchable rocker arm includes a pair of arms that are rotatably coupled to one another. The pair of arms are switchable between a latched state, in which they are prevented from rotating relative to one another, and an unlatched state, in which they are permitted to rotate relative to one another.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY

Lightweighting continues to be a sought-after solution for many reasons such as fuel economy and cost savings. But, durability and reliability are needed. So, a combination of solid and hollow parts are combined to achieve both goals. An additional benefit is the option to combine light and heavy materials to arrive at combinations of durable and light features.

Further, by using metal sheet stamping technology, the manufacturing process can be streamlined and made more cost-effective by, for example, avoiding the need for further machining required by other manufacturing solutions.

A rocker arm assembly can comprise: a latch assembly; a primary arm configured to receive the latch assembly; and a secondary arm configured to receive the latch assembly; wherein the secondary arm comprises: a secondary arm body and a piston support ring; and wherein a pivot slot passes through the primary arm, the secondary arm body, and the piston support ring.

The rocker arm assembly can also comprise a secondary arm body manufactured by metal sheet stamping.

A rocker arm assembly can also include a primary arm comprising primary sidewalls defining a pocket in which the secondary arm can be rotatably seated, and wherein the pivot slot passes through the primary sidewalls.

The rocker arm assembly can also include a primary arm comprising a valve end and a pivot slot.

The rocker arm assembly can comprise a piston support ring affixed to the secondary arm body.

The rocker arm assembly can include a latch assembly with the ability to selectively latch and unlatch the primary arm relative to the secondary arm.

The rocker arm assembly can include a secondary arm comprising a bearing end.

The rocker arm assembly can comprise a lost motion spring assembly seated between the bearing end of the secondary arm and the primary arm.

A rocker arm assembly can have a secondary arm comprising secondary sidewalls that define a secondary pocket in which the piston support ring can be seated.

The rocker arm assembly can include a pivot slot configured to seat a rocker shaft, and wherein the piston support ring comprises a piston ring channel for fluid communication from the pivot slot to the latching assembly.

The rocker arm assembly with a latch assembly comprising: a main latch pin assembly comprising a first diameter on a first main pin face, and a secondary latch piston comprising a second diameter on a secondary piston face, wherein the secondary latch piston is configured to selectively act on the main latching pin assembly, wherein the main latch pin assembly is biased to oppose the secondary latch piston, and wherein the first diameter is greater than the second diameter.

A rocker arm assembly can include a lost motion spring assembly affixed to the primary arm and the secondary arm with mounting pins.

The rocker arm assembly can include a primary arm comprising a triangular configuration of the valve end, the latch slot, and the piston ring bore holes.

The rocker arm assembly can have a secondary arm comprising a triangular configuration with the bearing end, the latch slot, and the spring assembly bore holes.

The rocker arm assembly can include a piston support ring comprising a latch slot in which the latch assembly is seated.

The rocker arm assembly can have a piston support ring comprising a single solid manufactured body.

The rocker arm assembly can include a piston support ring comprising a pivot slot, a latch slot, a piston ring channel, and slots for affixing the piston support ring to the secondary arm body.

The rocker arm assembly can have a piston support ring comprising a body in a key shape.

The rocker arm assembly can include a piston support ring comprising a body in a tri-lobed ring shape.

The rocker arm assembly can include a piston support ring coaxial with the pivot slot.

The rocker arm assembly can have a secondary arm body that is a hollow body.

The rocker arm assembly can include a secondary arm body that frames the piston support ring.

The rocker arm assembly can have a latch assembly held in the latch slot by a bushing.

The rocker arm assembly can have a piston support ring comprising a bore in which the latch assembly is seated.

The rocker arm assembly can include a lost motion spring assembly configured to, when the latch assembly is unlatched, absorb motion from the secondary arm to prevent the secondary arm motion from propagating through the rocker arm assembly.

Additional objects and advantages will be set forth in part in the description which follows, and in part will be obvious from the description, or can be learned by practice of the disclosure. The objects and advantages will also be realized and attained by means of the elements and combinations particularly pointed out in the appended claims.

DETAILED DESCRIPTION

Figure 1:
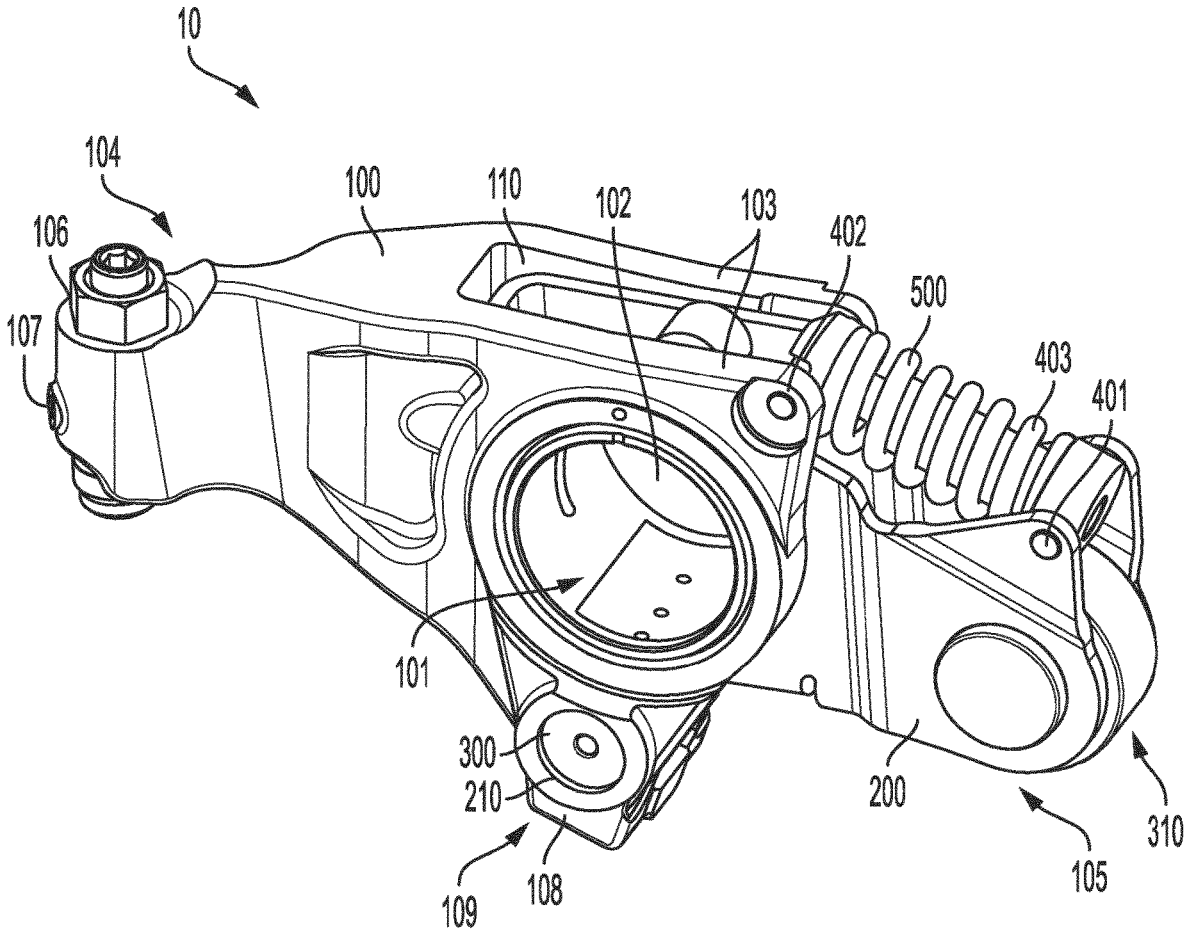
FIG. 1 is a perspective view of a rocker arm assembly with a latching pin assembly.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

A rocker arm assembly 10 can comprise a primary arm 100, a secondary arm 200, a latch assembly 300, and a lost motion spring assembly 500. The rocker arm assembly can further comprise a valve end 104 on the primary arm and a bearing end 105 on the secondary arm. The primary arm 100 and secondary arm 200 can be rotatably coupled to one another via a rocker shaft. The rocker shaft can comprise an optional bushing 101 or another structure to alleviate shear or wear, or to provide alignment. By splitting the rocker arm assembly 10 to comprise a pivot slot 102 in which a rocker shaft can be seated, the secondary arm 200 can pivot around the primary arm 100 (with or without optional bushing 101) in the pivot slot 102. The rocker shaft can be a free-floating axle to minimize wear and friction losses.

Optionally, the valve end 104 can comprise a capsule bore 106. An actuation capsule such as a castellation capsule, a hydraulic lash adjuster, a switching capsule, among many options can be installed in the capsule bore 106. In FIG. 1, the capsule bore 106 is shown with a mechanical lash adjuster. An optional vent 107 is also included in FIG. 1.

The primary arm 100 can comprise a pair of primary sidewalls 103 extending substantially parallel to each other. Primary sidewalls 103 can define a primary pocket 110 in which the secondary arm 200 can be seated, at least partially, as shown in FIG. 1.

Figure 2:
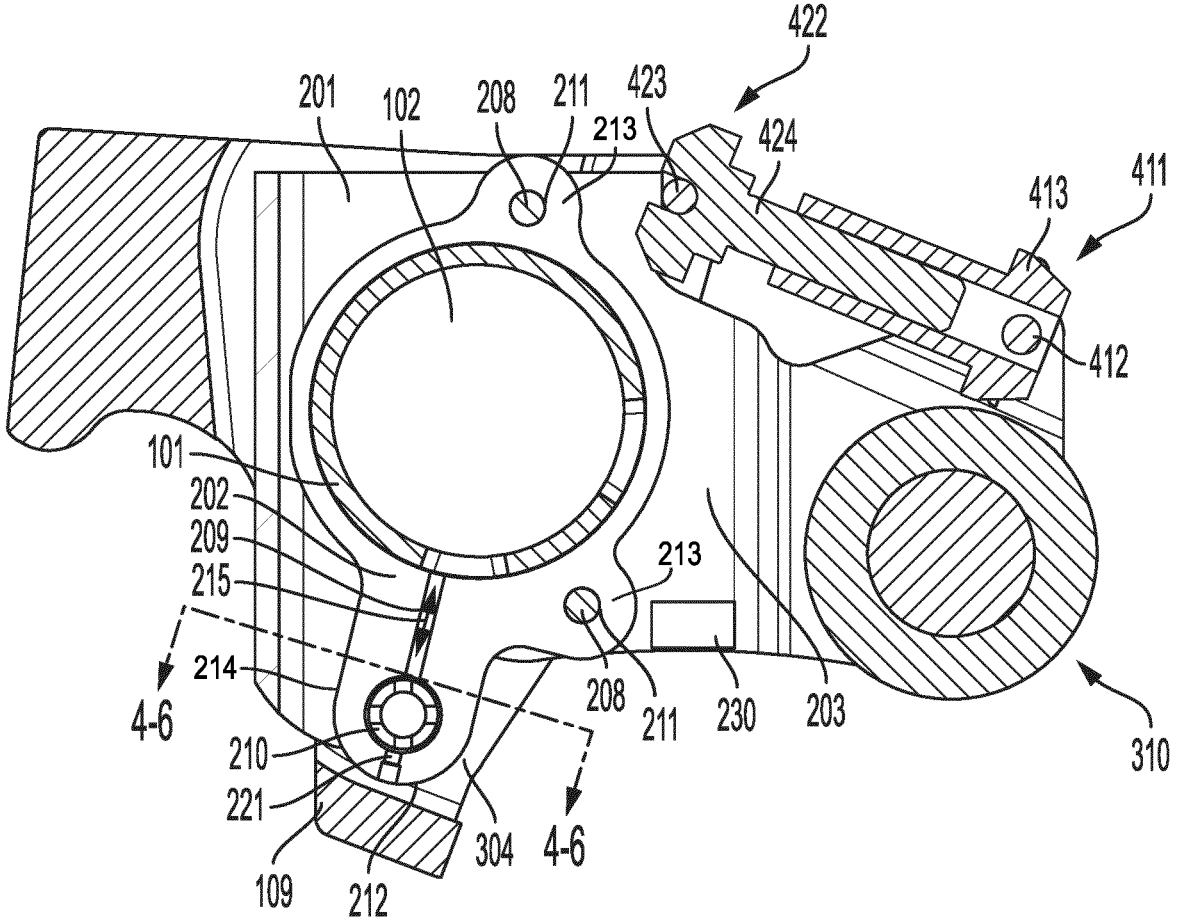
FIG. 2 is a cross-section view of a rocker arm assembly with a latching pin assembly. A piston support ring is shown.
Figure 2A:
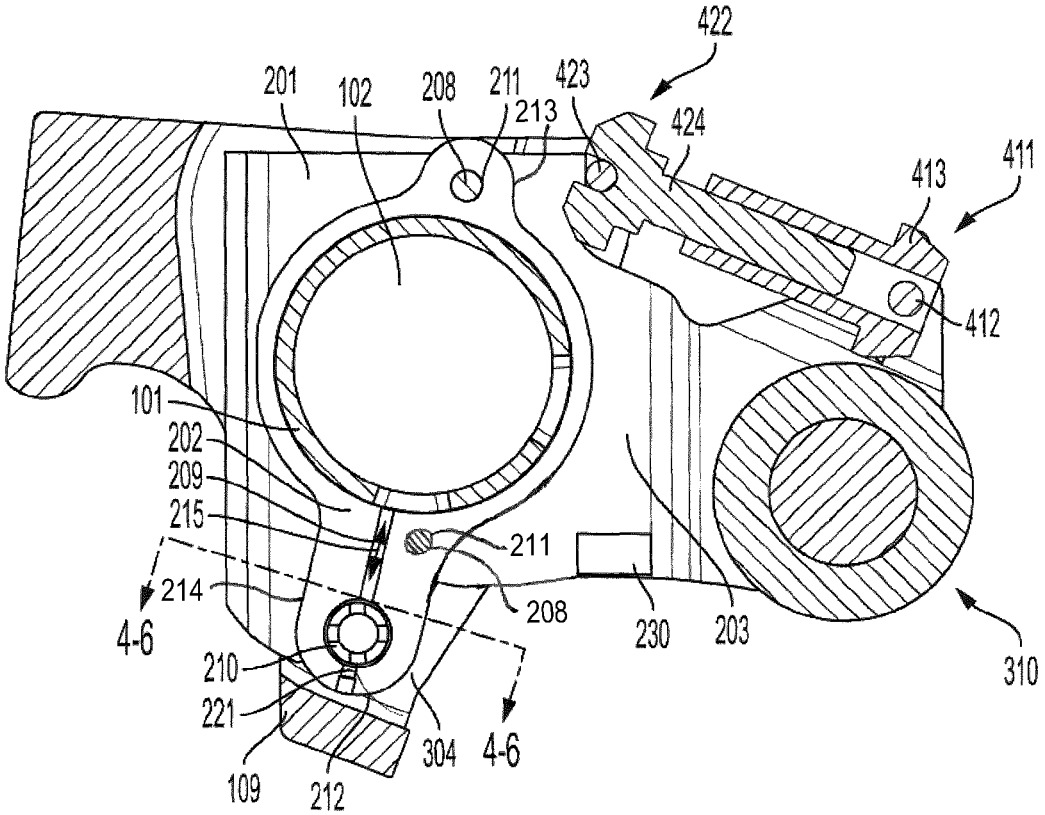
FIG. 2*a* is a cross-section view of an alternative rocker arm assembly with a latching pin assembly. An alternative piston support ring is shown.

As seen in FIGS. 2 and 2*a*, the secondary arm 200 can comprise at least a secondary arm body 201 and a piston support ring 202.

Pivot slot 102 can be defined by each of the primary sidewalls 103 in primary arm 100, as well as by secondary arm 200. Pivot slot 102 passes through the primary arm 100 as well as the secondary arm 200, including the secondary arm body 201 and piston support ring 202 of the secondary arm 200.

At least the secondary arm 200, including the secondary arm body 201, can be manufactured as metal sheet stamped bodies using metal sheet stamping technology. Metal sheet stamping technology, as compared to other manufacturing processes, can reduce the time and cost required to manufacture components by avoiding the need for further machining operations. The primary arm 100 is illustrated as a solid body and the piston support ring 202 is illustrated as a solid body, while the secondary arm body 201 is illustrated as a hollow body. It could be possible to include additional hollow body components should hydraulic control be effectuated another way. Additional techniques, such as 3D printing or casting can be used for forming the hollow bodies, as alternatives to metal sheet stamping.

Figure 3:
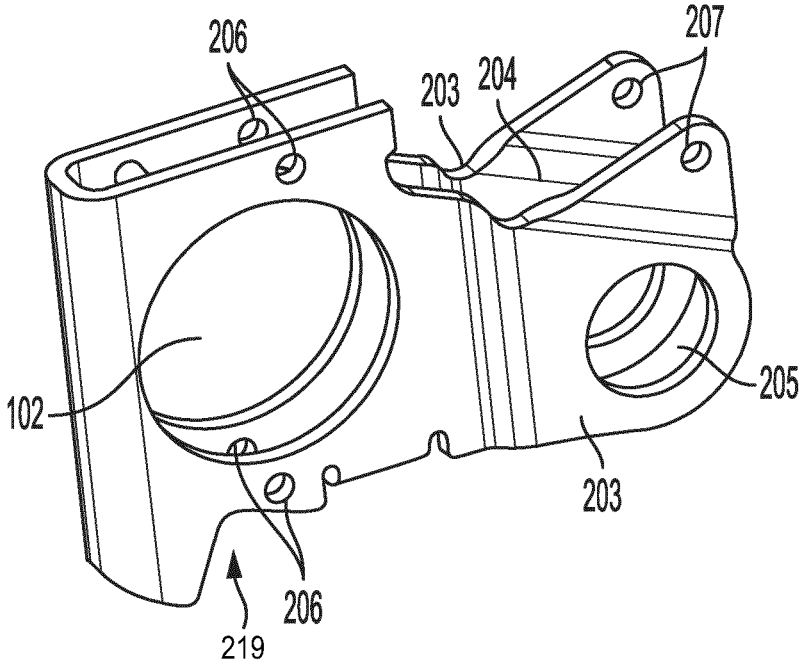
FIG. 3 is a perspective view of a secondary arm body.

The secondary arm body 201, as shown in FIG. 3, can comprise secondary sidewalls 203 that define a hollow frame secondary pocket 204. The secondary pocket 204 can seat the piston support ring 202. The secondary arm body 201 comprises apertures forming a pivot slot 102 and a bearing slot 205. The secondary arm body 201 can also include piston ring bore holes 206 and spring assembly bore holes 207, or other mechanisms, for mounting a piston support ring 202 and lost motion spring assembly 500, respectively. Other fastening techniques can be used in place of piston ring bore holes 206 and spring assembly bore holes 207, such as tabs, prongs, rivets, slots, cleats, among others. The piston support ring 202 can also include optional leakage port 221.

The primary arm 100 can comprise a triangular configuration with the valve end 104, the latch slot 210, and the piston ring bore holes 206. The secondary arm 200 can comprise a triangular configuration with the bearing end 310, the latch slot 210, and the spring assembly bore holes 207.

As seen in FIGS. 1, 2, 2*a*, and 3, the piston support ring 202 can be seated in secondary pocket 204 and affixed to the secondary arm body 201 with pins 208 or other affixing mechanisms. The piston support ring 202 defines apertures for the pivot slot 102, secondary arm bore holes 211, piston ring channel 209, and latch slot 210. The piston support ring 202 can comprise a single, solid body and take the shape of a key or a tri-lobed ring, coaxial with the pivot slot 102. Piston support ring 202 can comprise a first material of a first hardness. The first material can be a single material that is a solid. A body of the material can be manufactured as a single solid. Then, the secondary arm 201 can comprise a second material. The second material can be of a different hardness than the first material. Having different bearing forces, it can be a lesser hardness than the first hardness.

The piston support ring 202 can comprise lands 213 for forming the secondary arm bore holes so as to distribute the secondary arm bore holes around the pivot slot 102. Or, one or more of the secondary arm bore holes 211 can be co-linear with the pivot slot 102 and latch slot 210. As yet another alternative, an extension portion 214 of the piston support ring 202 can extend from the pivot slot 102. The extension portion 214 can comprise one or more secondary arm bore holes 211 and the latch slot 210, as shown in FIG. 2*a*. At least one land 213 can extend from another portion of the pivot support ring 202. As another option, the pivot support ring 202 of FIG. 2*a* can comprise mirror image secondary arm bore holes 211. Flow path 215 can also be included in the extension portion 214 to connect the pivot slot 102 with the latch slot 210.

The piston support ring 202 can be affixed to the secondary arm body 201, for example, as shown in FIGS. 1, 2, and 2*a*, wherein the piston support ring 202 comprises secondary arm bore holes 211 and the secondary arm body 201 has piston ring bore holes 206. Piston ring bore holes 206 can be aligned with secondary arm bore holes 211. The piston support ring 202 can then be affixed to the secondary arm 200 by use of pins 208 or other mechanisms placed through piston ring bore holes 206 and secondary arm bore holes 211. For example, a secondary body shelf 230 of the stamped secondary arm body 201 can form a travel limit, shim, or guide for the piston support ring 202. Or, a cross-piece, such as a stake or mating stamped edge, can be added as a stabilizer to one or both of the secondary arm body 201 or piston support ring 202. The latch slot 210 supports the placement of latch assembly 300 and the piston ring channel 209 allows the flow of actuation fluid through the flow path 215 between the rocker shaft and the latching assembly 300.

A rocker arm assembly 10 can comprise the latch assembly 300. A primary arm 100 can be configured to receive one or both main latch pin assembly 501, 502. Piston support ring 202 can be configured to receive one or both secondary latch piston 503, 561. Secondary arm 200 frames the piston support ring 202 and can comprise additional bores for housing one or both secondary latch pistons 503, 561. Or, secondary arm 200 can comprise diameter changes for enabling the main latch pin assembly 501, 502 to step out from a first locked-lift height in the piston support ring 202 to a second locked-lift height in the secondary arm 200. As drawn, the secondary arm 200 comprises a cut-out 219 to step around the latch slot 210 of the piston support ring 202. As drawn in FIG. 3, the secondary arm 200 does not interfere with the latching and unlatching of the latch assembly by virtue of the cut-out 219.

By splitting the rocker arm assembly 10 to comprise a pivot slot 102, the secondary arm 200 can pivot around a rocker shaft (with or without optional bushing 101) in the pivot slot 102. The split rocker arm assembly 10 can also form mirror image portions for housing the first and second main latch pin assemblies 501, 502. The mirror image portions can flank the extension portion 214 of the pivot support ring 202. So, a latch shelf 108 can be formed as part of the primary rocker arm body 100. The latch shelf 108 can include a latch slot 210 comprising a pair of primary latch bores 505, 506. A portion of the latch shelf 108 can comprise a primary travel limit 109.

The primary arm 100 can comprise the latch shelf 108 proximal to the pivot slot 102. The latch assembly 300, comprising main latch pin assembly 501, 502, can be installed in primary latch bores 505, 506 in the latch shelf 108. Lubrication ports to the primary latch bores 505, 506 from the pivot slot 102 are optional.

The piston support ring 202 can comprise a latch slot 210. The secondary latch pistons 503, 561 can be installed in latch slot 210 in the extension portion 214.

The primary arm 100 can comprise a primary travel limit 109. The secondary arm 200 can comprise a secondary travel limit 212. The secondary travel limit 212 can contact the primary travel limit 109 when the latch assembly 300 is latched. But, the secondary travel limit 212 can be configured to swing away from the primary travel limit 109 when the latch assembly is unlatched. The primary travel limit 109 can comprise a wall or prong or finger of material of the latch shelf 108. A complementary wall or prong or finger of material on the latch extension 304 can be shaped to abut the primary travel limit 109. Lightweighting and durability can be factors in the size and shape of the complementing primary travel limit 109 and secondary travel limit 212. In another aspect, the cooperation of the primary travel limit 109 and secondary travel limit 212 serve to smooth latching and unlatching of the latch assembly 300. By restricting overtravel of the primary arm 100 relative to the secondary arm 200, the primary latch bore 505, 506 aligns readily with latch slot 210. By forming bore steps 351, 352 in the latch slot 210, lash take-up can be designed into the rocker arm assembly 10. Lash take-up can also be designed into the rocker arm assembly 10 by way of the outer step 514, 524 on the pin bodies 511, 521.

A latch assembly 300 can comprise at least one main latch pin assembly 501 and at least one secondary latch piston 503. Several figures show first and second main latch pin assembly 501, 502 working together with first and second secondary latch pistons 503, 561. While a receptacle wall can be used to form a system for the single main latch pin assembly 501 and single secondary latch piston 503, the illustration comprising pairs can reduce the spring force of pin springs 519, 529 and actuation force of actuation fluid to a pair of secondary latch pistons 503, 561. For convenience, the first and second main latch pin assemblies 501, 502 can be referred to as outer latch pins while the secondary latch pistons 503, 561 can be referred to as inner pistons.

First and second main latch pin assemblies 501, 502 can comprise first and second latch pins 571, 572 with pin bodies 511, 521 comprising a first diameter D1 on a first main pin face 512, 522. Secondary latch pistons 503, 561 can comprise piston bodies 542, 562 comprising a second diameter D2 on a secondary piston face 543, 563. The first diameter D1 can be greater than the second diameter D2 (D1>D2). This relationship can be true even if the main latch pin assemblies 501, 502 comprise a main pin body 511, 521 that is stepped from an outer diameter OD1 to the first diameter. Outer step 514, 524 can be formed. Several optional benefits can be implemented: the primary latch bores 505, 506 can have a greater diameter than the first diameter to give stability to the primary latch pin assemblies; the pin springs 519, 529 can be wider to yield flexibility in the spring force k; and, the outer steps 514, 524 can serve to set lash for the rocker arm assembly 10. Additional features on the main pin bodies 511, 521 can comprise at least one anti-rotation flat (not shown). Also, a spring cup 516, 526 can guide the pin springs 519, 529 as they expand and collapse against the bushing or snap ring 517, 527 seated in guide grooves 135, 136 of the primary arm latch bores 505, 506. Additional spring guides 518, 528, as necks or grooves, can be formed in the bushing or snap ring 517, 527. The travel of the main pin bodies 511, 521 in the primary latch bores 505, 506 can be restricted by the placement of the bushings or snap rings 517, 527.

The secondary latch pistons 503, 561 can be configured to selectively act on the main latching pin assemblies 501, 502. This can be accomplished through actuation fluid from a rocker shaft to the rocker bores via the piston ring channel 209. The main latch pin assemblies 501, 502, by the pin springs 519, 529, can be biased to oppose the secondary latch pistons 503, 561.

Figure 1A:
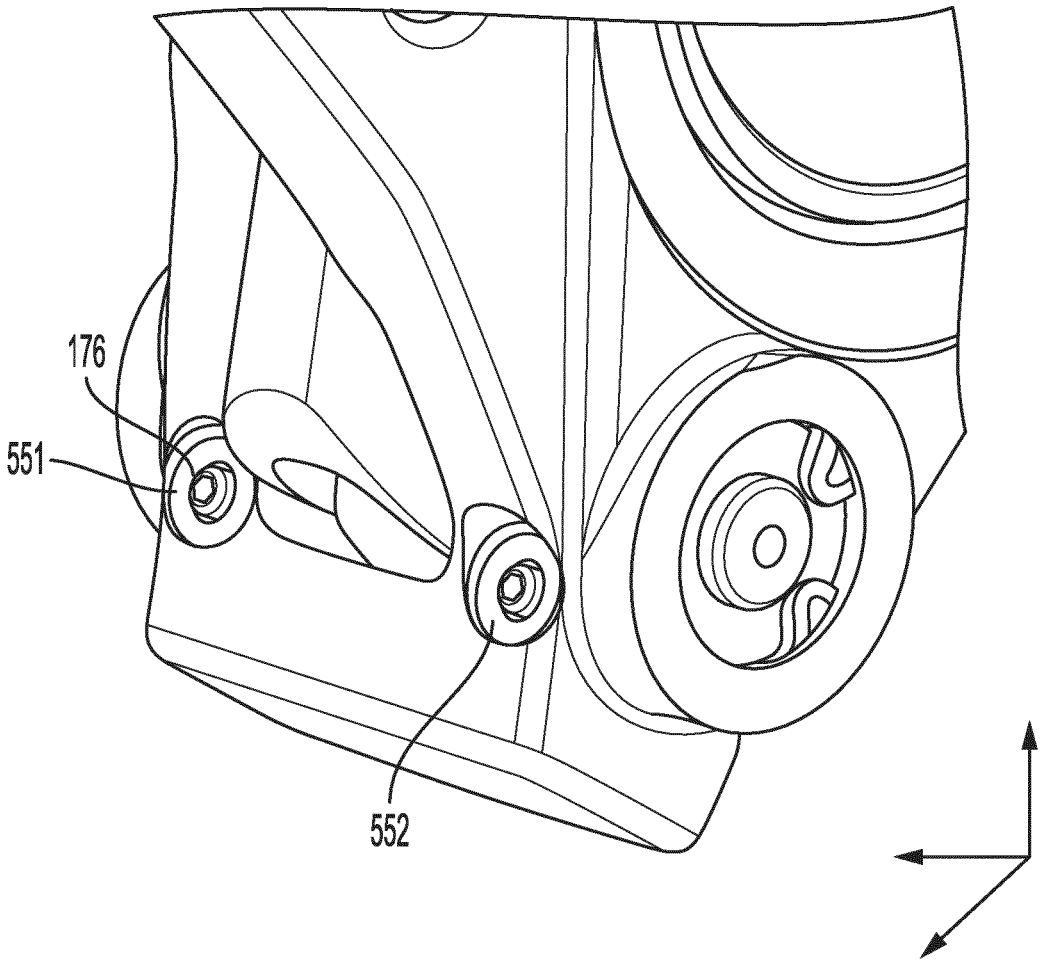
FIG. 1*a* is a detailed perspective view of a rocker arm assembly showing anti-rotation bores and anti-rotation pins.

As seen FIGS. 1 and 1*a*, the latch shelf 108 can comprise one or more anti-rotation bore 176 and one or more anti-rotation pins 551, 552 installed in the anti-rotation bores 176.

The latch slot 210 can be stepped from a first inner diameter ID1 guiding the piston bodies 542, 562 or the secondary latch pistons 503, 561 to a second inner diameter ID2 that is larger than the first inner diameter (ID2>ID1). The main latch pin assembly 501, 502 can comprise the main latch pins 571, 572 with main pin bodies 511, 521 stepped from an outer diameter to the first diameter D1. The outer step 514, 524 so formed can abut the second inner diameter ID2 when the secondary latch piston 503, 561 is passive. The primary latch pin assembly 501, 502 can be biased to abut the second inner diameter ID2 when the secondary latch piston 503, 561 is passive. No actuation fluid pressure is supplied to the cavity 544, 564 in the passive condition. But, actuation fluid is supplied directly to the piston ring channel 209 in the secondary arm 200 to cause the first and second secondary latch pistons 503, 561 to act on the first and second main latch pin assemblies 501, 502. Bearing end 310 can alternatively comprise a tappet or other sliding surface. The latch slot 210 and its stepped diameters can be used for lash-setting and lift-height selection.

The rocker arm assembly 10 can comprise a lost motion spring assembly 500 spanning from the primary arm 100 to the secondary arm 200. The lost motion spring assembly 500 can bias the latch extension 304 towards the latch shelf 108 so that the primary travel limit 109 contacts the secondary travel limit 212 during a portion of the valve cycle. The lost motion spring assembly 500 can comprise a spring guide 413 and plunger 424 secured by mounting pins 401, 402 at the pivoting spring assembly bore holes 207. A swivel end 411 can comprise a pin hole 412 for mounting pin 401 while stay end 422 comprises pin slot 423 for mounting pin 402. Lost motion spring 403 pushes the swivel end 411 and stay end 422 apart to return the rocker arm assembly to a position where the latch assembly 300 is aligned for latching or unlatching. But, lost motion spring 403 can be compressed when the latch assembly 300 is unlatched so that a lift profile is absorbed therein.

The rocker arm assembly 10 can comprise a bearing end 105 on the secondary arm 200 and a valve end 104 on the primary arm 100. The bearing end 105, the valve end 104, and the latch assembly 300 can be configured to surround a rocker shaft in a triangular distribution. The rocker shaft being mountable in the pivot slot 102, this can also be phrased that the bearing end 105, the valve end 104, and the latch assembly 300 can be configured to surround the pivot slot 102 in a triangular distribution. Said yet another way, while the lost motion spring assembly 500 is balanced over the pivot slot 102 and the bearing end 105, the latch assembly 300 is balanced under the pivot slot 102. The actuation fluid and latch assembly 300 do not interfere with actuation fluid to any capsule or actuation in the valve end 104, nor do they interfere with ordinary lubrication circuits. The location of the latch assembly 300 under the pivot slot 102 yields a low-conflict area of the rocker arm assembly 10 to add deactivation mechanisms.

As an option, the valve end 104 can comprise a capsule bore 106. An actuation capsule such as a castellation capsule, a hydraulic lash adjuster, a switching capsule, among many options can be installed in the capsule bore 106. In FIG. 1, a mechanical lash device is shown in the capsule bore 106. An optional vent 107 is included in the valve end 104.

The secondary arm 200 can comprise a piston ring channel 209 to the secondary latch pistons 503, 561. The secondary latch pistons 503, 561 can comprise a piston body 542, 562 cupped to receive actuation fluid. The actuation fluid can be, for example, a hydraulic fluid such as pressurized oil. The piston body can be crenelated or gapped to form an actuation fluid passage.

The secondary latch pistons 503, 561 can comprise piston bodies 542, 562 cupped to receive an actuation fluid. A cavity 544, 564 can be formed in each piston body 542, 562 to receive the actuation fluid. The piston bodies 542, 562 can be crenelated or gapped to form an actuation fluid passage 548, 568. Teeth 545, 565 spaced with gaps are one way to form the actuation fluid passages 548, 568. An optional piston spring (not pictured) can push the secondary latch pistons 503, 561 apart by a preset amount that is typically overcome by the pin springs 519, 529. But, the optional piston spring can prime the motion of the secondary latch pistons 503, 561. The optional piston spring can push the piston facings 543, 563 to contact the main pin facings 512, 522.

A latch assembly 300 disclosed herein provides a more reliable latching and unlatching function in a rocker arm assembly 10 such as a deactivating roller rocker arm (RRA) when the loads could otherwise cause the latching pins to stick.

Hydraulic activation of the latching function can be ported through the rocker arm assembly 10 by way of a rocker shaft with the hydraulic activation contained in the rocker arm assembly 10. Then, external hoses and actuators are not mandatory. The main latch pin assemblies 501, 502 are in a normally latched condition due to the reaction of the pin springs 519, 529. Since the function activation is not directly applied on them, this allows a longer guided length of the pin bodies 511, 521. The first and second secondary latch pistons 503, 561 do not receive the latching load but do receive the force of the oil during activation of the deactivation function of the RRA. With no latching load applied, these first and second secondary latch pistons 503, 561 can be smaller. The combination of the two latching systems to form the latch assembly 300 allows the rocker arm assembly 10 to transmit the cam lift to the valve when the latch assembly 300 is engaged (latched) and allows the rocker arm assembly 10 to not transmit motion to the valve when the first and second secondary latch pistons 503, 561 receive hydraulic pressure to disengage the main latch pin assemblies 501, 502.

The rocker arm assembly 10 can be made by the primary arm 100 that provides the case for the main latch pin assemblies 501, 502 and the pin springs 519, 529 and the secondary arm 200 that provides the case for the first and second secondary latch pistons 503, 561 and the oil gallery for the function activation. The secondary arm can also provide a latching feature for the main latch pin assemblies 501, 502, as by diameter changes to the latch slot 210.

Figure 4:
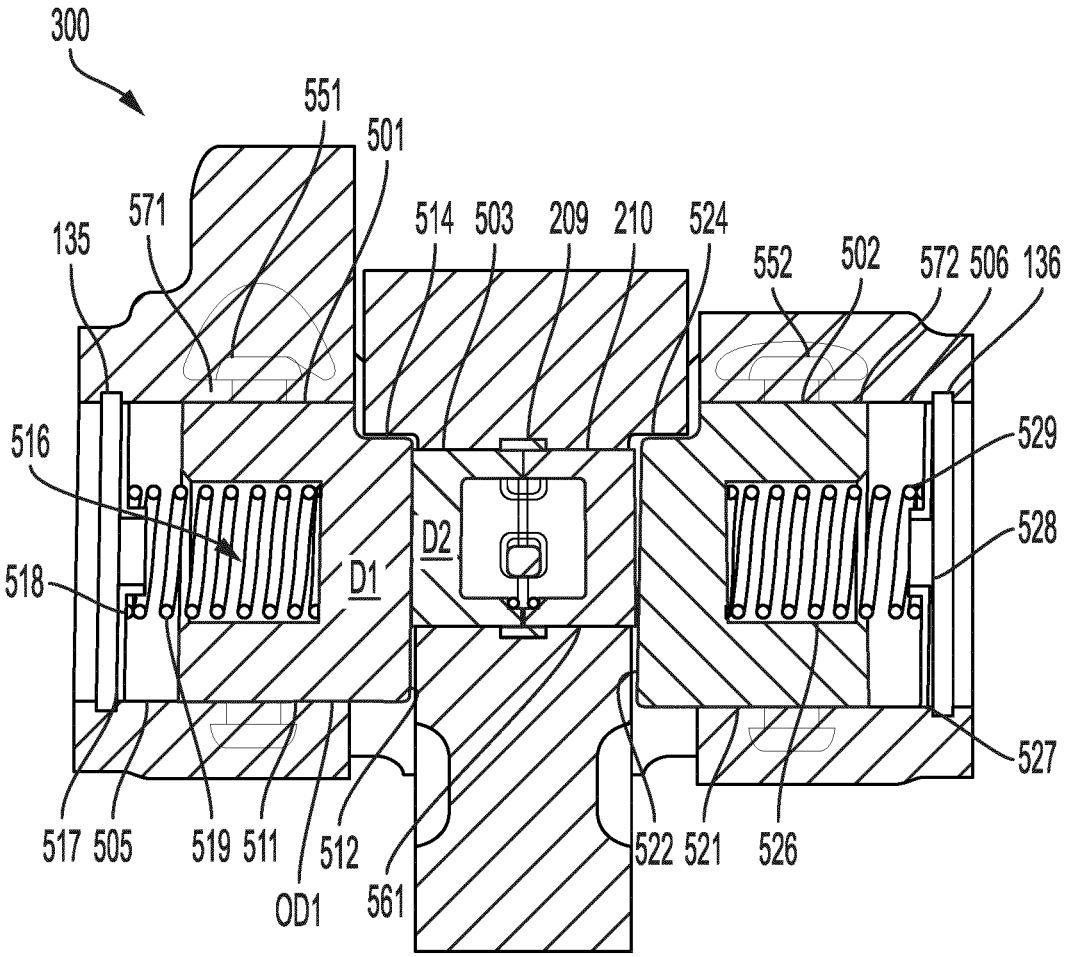
FIG. 4 is a cross-section view of the latch assembly latched in the rocker arm assembly.

DRIVE MODE: FIG. 4 shows that in this condition the main latch pin assemblies 501, 502 are pushed to jut out of the primary arm 100 due to the pin springs 519, 529 and the assemblies are latched on the latch slot 210 (which can include the second inner diameter ID2 latching feature on the secondary arm 200). The secondary latch pistons 503, 561 are retracted inside the secondary arm 200 since they do not receive any pressure from the piston ring channel 209. In this configuration, when a cam rotates from base circle to a lift lobe, the motion is transmitted to the valve due to the connection provided by the main latch pin assemblies 501, 502 on the secondary arm 200.

Figure 5:
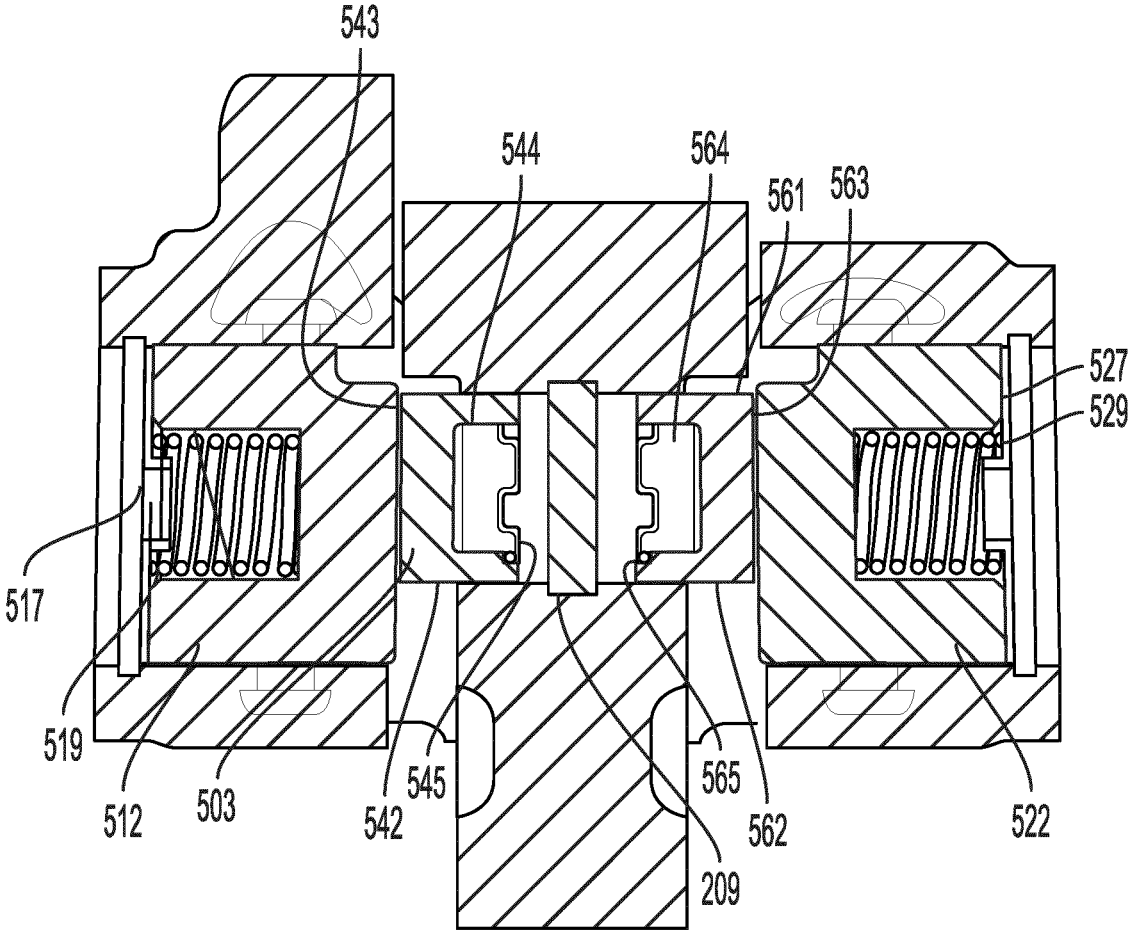
FIG. 5 is a cross-section view of the latch assembly unlatched in the rocker arm assembly.
Figure 6:
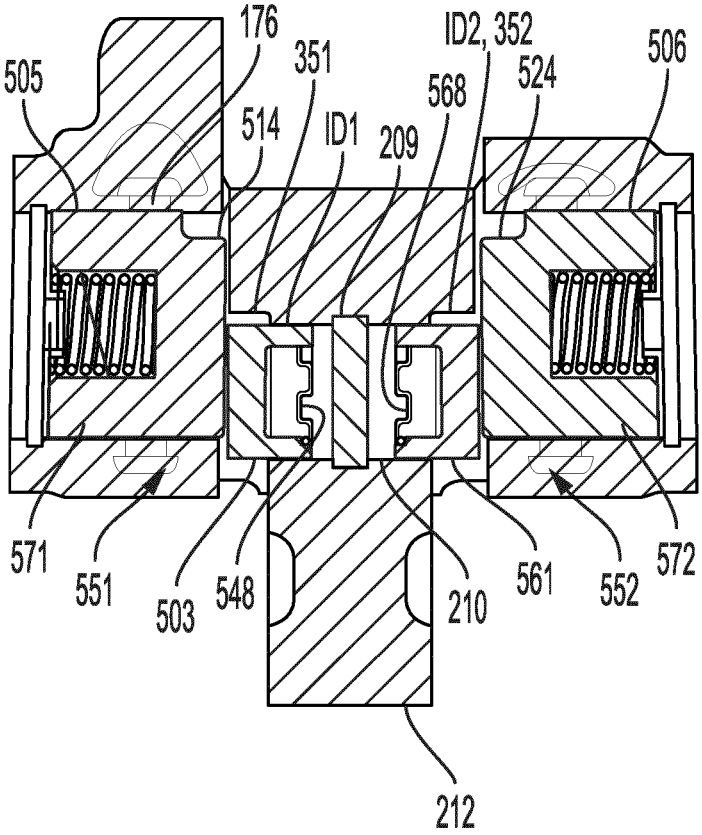
FIG. 6 is a cross-section view of the latch assembly unlatched in the rocker arm assembly.

FUNCTION ACTIVATION: when the deactivation of the rocker arm assembly 10 is selected, an oil input is sent to the piston ring channel 209 in the secondary arm 200. This allows the secondary latch pistons 503, 561 to expand and push against the main latch pin assemblies 501, 502. When the cam is on base circle, a geometrical lash between the main latch pin assemblies 501, 502 and the latching feature on the secondary arm 200 is provided. The geometrical lash can be a designed—for gap between the main latch pin assemblies 501, 502 and the second inner diameter ID2. When included, this can be a designed—for gap between outer step 514, 524 and inner diameter ID2. In this condition, it is possible for the secondary latch pistons 503, 561 to compress the main latch pin assemblies 501, 502 and disengage the primary arm 100 from the secondary arm 200. This is shown in FIG. 5. As for timing, when the cam is on a lift lobe, if the main latch pin assemblies 501, 502 are still engaged, the force between the main latch pin assemblies 501, 502 and the secondary arm 200 latching feature is higher than the force from the actuation oil on the secondary latch pistons 503, 561 and the disengagement is not provided. The latch assembly 300 does not convert from latched to unlatched if the actuation oil is provided during lift, but it can convert on base circle when the geometrical lash takes pressure from the secondary arm 200 off of main latch pin assemblies 501, 502. Functions for the rocker arm assembly 10 can include various variable valve actuation (VVA) techniques such as cylinder deactivation, braking, internal exhaust gas recirculation, early or late valve opening or closing, etc. Additional inner diameters can be included as the additional latching features to enable the other VVA techniques. For example, instead of valve deactivation, a different valve lift can be supplied as the VVA technique by stepping the main latch pin assemblies 501, 502 from an initial smaller inner diameter to a larger inner diameter. Deactivation mode is the working example, but it is not exclusive.

DEACTIVATION MODE: when the secondary latch pistons 503, 561 are fully extended, the main latch pin assemblies 501, 502 are not able to engage with the latching feature on the secondary arm 200. This allows a relative motion between the secondary arm 200 and the primary arm 100. When the cam rotates on the lift lobe, the secondary arm 200 starts rocking, but it does not transmit the motion to the primary arm 100. The secondary arm 200 instead rocks about the pivot slot 102 while the primary arm 100 stays steady and the valve(s) remains closed. To prevent the secondary arm 200 from lifting away from the cam, a spring based lost motion assembly 500 can provide enough load from the secondary arm 200 to the cam. The spring force of lost motion spring 403 can be small enough such that it does not transmit motion to the valve. The balance of the lost motion assembly 500 over the bearing end 105, and the placement of the spring assembly bore holes 207 anterior to the latch assembly 300 and pivot slot 102, can concentrate the weight and force of the lost motion assembly 500 over the bearing end 105. The bearing end 105 can follow the cam and can return to the contacting of primary travel limit 109 and secondary travel limit 212.

Other implementations will be apparent to those skilled in the art from consideration of the specification and practice of the examples disclosed herein.

What is claimed is:

1. A rocker arm assembly comprising:

a latch assembly;

a primary arm configured to receive a portion of the latch assembly; and a secondary arm configured to receive at least a second portion of the latch assembly, wherein the secondary arm comprises:

a secondary arm body; and a piston support ring, and a pivot slot passing through the primary arm, the secondary arm body, and the piston support ring, wherein the secondary arm comprises secondary sidewalls that define a secondary pocket in which the piston support ring is seated.

2. The rocker arm assembly of claim 1, wherein the secondary arm body is manufactured by metal sheet stamping.

3. The rocker arm assembly of claim 1, wherein the primary arm comprises primary sidewalls defining a pocket in which the secondary arm is rotatably seated, and wherein the pivot slot passes through the primary sidewalls.

4. The rocker arm assembly of claim 1, wherein the piston support ring is affixed to the secondary arm body.

5. The rocker arm assembly of claim 1, wherein the latch assembly selectively latches and unlatches the primary arm relative to the secondary arm.

6. The rocker arm assembly of claim 1, wherein the rocker arm assembly further comprises a lost motion spring assembly seated between a bearing end of the secondary arm and the primary arm.

7. The rocker arm assembly of claim 6, wherein the lost motion spring assembly is affixed to the primary arm and the secondary arm with mounting pins.

8. The rocker arm assembly of claim 6, wherein the primary arm comprises a triangular configuration of a valve end, a latch slot, and piston ring bore holes.

9. The rocker arm assembly of claim 6, wherein the secondary arm comprises a triangular configuration with the bearing end, a latch slot, and spring assembly bore holes.

10. The rocker arm assembly of claim 1, wherein the pivot slot is configured to seat a rocker shaft, and wherein the piston support ring comprises a piston ring channel for fluid communication from the pivot slot to the latching assembly.

11. The rocker arm assembly of claim 1, wherein the latch assembly comprises:

a main latch pin assembly comprising a first diameter on a first main pin face, and a secondary latch piston comprising a second diameter on a secondary piston face, wherein the secondary latch piston is configured to selectively act on the main latching pin assembly, wherein the main latch pin assembly is biased to oppose the secondary latch piston, and wherein the first diameter is greater than the second diameter.

12. The rocker arm assembly of claim 1, wherein the piston support ring comprises one of a latch slot or a bore in which the latch assembly is seated.

13. The rocker arm assembly of claim 1, wherein the piston support ring comprises a single solid manufactured body.

14. The rocker arm assembly of claim 1, wherein the piston support ring comprises a pivot slot, a latch slot, a piston ring channel, and slots for affixing the piston support ring to the secondary arm body.

15. The rocker arm assembly of claim 14, wherein the piston support ring is coaxial with the pivot slot.

16. The rocker arm assembly of claim 1, wherein the secondary arm body is a hollow body.

17. The rocker arm assembly of claim 1, wherein the latch assembly is held in a latch slot by a bushing.

18. A rocker arm assembly comprising:

a latch assembly;

a primary arm configured to receive a portion of the latch assembly; and a secondary arm configured to receive at least a second portion of the latch assembly, wherein the secondary arm comprises:

a secondary arm body; and a piston support ring, and a pivot slot passing through the primary arm, the secondary arm body, and the piston support ring, wherein the piston support ring comprises one of a body in a key shape or a tri-lobed ring shape.

19. A rocker arm assembly comprising:

a latch assembly;

a primary arm configured to receive a portion of the latch assembly; and a secondary arm configured to receive at least a second portion of the latch assembly, wherein the secondary arm comprises:

a secondary arm body; and a piston support ring, and a pivot slot passing through the primary arm, the secondary arm body, and the piston support ring, wherein the secondary arm body frames the piston support ring.

* * * * *